US007999204B2

(12) United States Patent
Kobayashi et al.

(10) Patent No.: US 7,999,204 B2
(45) Date of Patent: Aug. 16, 2011

(54) KEY FRAME AND COVER MEMBER FOR PUSH BUTTON SWITCH

(75) Inventors: Takato Kobayashi, Saitama (JP); Yasuo Iwabuchi, Saitama (JP); Kimihiko Watanabe, Saitama (JP)

(73) Assignee: Shin-Etsu Polymer Co., Ltd., Tokyo (JP)

( * ) Notice: Subject to any disclaimer, the term of this patent is extended or adjusted under 35 U.S.C. 154(b) by 551 days.

(21) Appl. No.: 12/063,023

(22) PCT Filed: Jul. 28, 2006

(86) PCT No.: PCT/JP2006/314981

§ 371 (c)(1),
(2), (4) Date: Feb. 5, 2008

(87) PCT Pub. No.: WO2007/018053

PCT Pub. Date: Feb. 15, 2007

(65) Prior Publication Data

US 2010/0236907 A1 Sep. 23, 2010

(30) Foreign Application Priority Data

Aug. 5, 2005 (JP) ..... 2005-228004

(51) Int. Cl.
*H01H 13/70* (2006.01)

(52) U.S. Cl. ..... 200/341

(58) Field of Classification Search ..... 200/5 R, 200/5 A, 341, 517, 293–296, 333; 341/22; 345/168, 169; 29/622; 455/550, 557
See application file for complete search history.

(56) References Cited

U.S. PATENT DOCUMENTS

| | | | | |
|---|---|---|---|---|
| 4,092,527 | A * | 5/1978 | Luecke | 708/140 |
| 4,184,321 | A * | 1/1980 | Tarusawa | 235/61 A |
| 5,153,589 | A * | 10/1992 | Heys et al. | 341/22 |
| 5,601,489 | A * | 2/1997 | Komaki | 463/44 |
| 6,212,066 | B1 * | 4/2001 | Fetterman | 361/679.17 |
| 6,259,044 | B1 * | 7/2001 | Paratore et al. | 200/5 A |
| 6,462,292 | B1 * | 10/2002 | Wang | 200/315 |

(Continued)

FOREIGN PATENT DOCUMENTS

CN 1244022 2/2000

(Continued)

OTHER PUBLICATIONS

Notification of Transmittal of Translation of the International Preliminary Report on Patentability (Chapter I or Chapter II of the Patent Cooperation Treaty) for International Application No. PCT/JP2006/314981 (5 pages).

(Continued)

*Primary Examiner* — Michael A Friedhofer
(74) *Attorney, Agent, or Firm* — Osha • Liang LLP

(57) ABSTRACT

An elastic projection elastically projecting outward is provided on the lower side and the lateral side of a hard base. The elastic projection functions as a fixing member when a cover member for a push button switch is fitted into a housing of the product. Inside an elastic projection is formed a space. When the elastic projection is pressed from the outside, the space enables the elastic projection which is elastically deformed inward, to proceed into the space. As a result, the elastic projection projecting from an outer peripheral line of the hard base can be elastically deformed so as to retract inwardly in the hard base.

20 Claims, 11 Drawing Sheets

U.S. PATENT DOCUMENTS

| | | | | |
|---|---|---|---|---|
| 6,559,398 | B2 * | 5/2003 | Takeda et al. | 200/339 |
| 6,861,594 | B2 * | 3/2005 | Sadowski et al. | 200/5 R |
| 6,975,504 | B2 * | 12/2005 | Robinson et al. | 361/659 |
| 7,579,561 | B2 * | 8/2009 | Wee et al. | 200/5 A |
| 2003/0109229 | A1 | 6/2003 | Takagi | |
| 2003/0231558 | A1 * | 12/2003 | Nakamura | 368/309 |
| 2004/0200712 | A1 | 10/2004 | Nishimura et al. | |
| 2005/0000788 | A1 | 1/2005 | Nishimura | |
| 2005/0078815 | A1 | 4/2005 | Saeki et al. | |
| 2005/0139460 | A1 | 6/2005 | Hosaka | |
| 2006/0017693 | A1 | 1/2006 | Nishimura | |
| 2007/0199814 | A1 | 8/2007 | Kobayashi et al. | |

FOREIGN PATENT DOCUMENTS

| | | | |
|---|---|---|---|
| CN | 1461981 | | 12/2003 |
| DE | 86 23 803 | U1 | 10/1986 |
| EP | 1 156 643 | | 11/2001 |
| EP | 1 746 616 | | 1/2007 |
| EP | 1 758 139 | | 2/2007 |
| FR | 2 865 601 | | 7/2005 |
| JP | 2001-351461 | | 12/2001 |
| JP | 3296610 | B2 | 4/2002 |
| JP | 2003-131787 | | 5/2003 |
| JP | 2004-71429 | | 3/2004 |
| JP | 2004-362891 | | 12/2004 |
| JP | 2005-100981 | | 4/2005 |
| JP | 2005-183151 | | 7/2005 |
| KR | 10-2004-0099046 | | 11/2004 |
| WO | 2004/112069 | | 12/2004 |
| WO | 2005/024871 | | 3/2005 |
| WO | 2005/041232 | | 5/2005 |
| WO | 2005/093770 | | 10/2005 |
| WO | 2005/098884 | | 10/2005 |
| WO | 2005/109460 | | 11/2005 |

OTHER PUBLICATIONS

Decision on Grant of Patent from the Korean Intellectual Property Office issued is patent application No. 2008-7005446, Dated Feb. 25, 2010, and partial English translation thereof, 3 pages.
English Patent Abstract of Japan for Application with Publication No. 06-232954, Publication Date: Aug. 19, 1994, 1 page.
Partial English translation from the Korean Intellectual Property Office of Patent Application with Publication No. 2004-0099046, Publication Date: Nov. 26, 2004, 1 page.
European Search Report for European Application No. 06781891.4-1231, mailed on Apr. 21, 2009 (6 pages).
Chinese Office Action for Chinese Application No. 200680025415.8, mailed on May 6, 2010 (6 pages).
esp@cenet patent abstract for Chinese Publication No. 1461981, Publication date Dec. 17, 2003 (1 page).
esp@cenet patent abstract for Chinese Publication No. 1244022, Publication date Feb. 9, 2000 (1 page).
Korean Office Action for Korean Application No. 10-2008-7005446, mailed on Oct. 15, 2009 (3 pages).
esp@cenet patent abstract for Japanese Publication No. 2001351461, Publication date Dec. 21, 2001 (1 pgae).
International Search Report (English) for PCT/JP2006/314981 mailed Aug. 22, 2006 (1 page).
esp@cenet patent abstract for JP2004362891 dated Dec. 24, 2004 (1 page).
esp@cenet patent abstract for JP2004071429 dated Mar. 4, 2004 (1 page).
esp@cenet patent abstract for JP2005100981 dated Apr. 14, 2005 (1 page).
esp@cenet patent abstract for JP2005183151 dated Jul. 7, 2005 (1 page).
esp@cenet patent abstract for JP2003131787 dated May 9, 2003 (1 page).

* cited by examiner

KEY FRAME AND COVER MEMBER FOR PUSH BUTTON SWITCH

TECHNICAL FIELD

The present invention relates to a key frame and a cover member for a push button switch used in a portable terminal such as a portable phone.

BACKGROUND ART

Portable terminals such as a portable phone and a PDA are widely in use in worldwide countries. Therefore, the character displayed on a key of the portable terminal must be printed in respective languages used in the countries. In the related art, a cover member for a push button switch is prepared for each language to be printed on a key, and is assembled and fixed to a housing of a product from a backside. The below-described Patent Document 1 discloses a technique related to a key sheet which is assembled and fixed to a housing of a product from a backside. The Patent Document 1 discloses in FIG. 5 a key sheet (11) which is assembled and fixed to a housing (101*a*) from a backside. The key sheet (11) is fixed to the housing (101*a*) with a periphery portion of a rigid resin plate (14) functioning as a so-called hook.

In addition, in the related art, a method is employed in which a hook is provided at a portion of an outer periphery of a cover member for a push button switch so that the cover member is fitted and fixed from a front side of the housing. FIG. 10 shows a well-known key frame in which a hook (projection) is provided at a portion of an outer periphery. The key frame is a member which supports a bottom portion of the cover member for the push button switch. The use of a key frame 91 having the projection 91*p* with a thin plate shape enables fitting, at a later time, of a cover member for a push button switch prepared for each language to a pre-assembled product, and, consequently, allows an increase in the degree of freedom in the manufacturing process.

Patent Document 1: Japanese Patent Application Laid-Open No. 2004-362891

DISCLOSURE OF THE INVENTION

Problem to be Solved by the Invention

A cover member for a push button switch in which a projection is provided at a part of the outer periphery is fitted to a housing by deforming the projection within a range of its very low elasticity. Therefore, there is a difficulty in fitting and a problem in which the key frame tends to be deformed when the key frame is fitted. In order to solve this problem, there may be considered a method in which a margin is provided in the size of the fitting portion provided on the side of the housing of the product. However, when a margin is provided in the size of the fitting portion, the position of the cover member may be shifted or rattled, resulting in degradation of the operability of the keys. In addition, due to the position shift or the like of the cover member, a force for fixing the cover member may be reduced, and may cause falling off of the cover member in a product dropping test which is executed after assembly.

The present invention has been conceived solve the above-described problem, and an object of the present invention is to provide a key frame and a cover member for a push button switch which can be easily fitted to a product and in which deformation during fitting can be prevented.

Means for Solving the Problem

The present invention provides a key frame which supports a bottom of a cover member for a push button switch, the key frame comprising a projection which is formed on at least a portion of an outer periphery of the key frame and which can elastically project outward, wherein the projection can be elastically deformed inward.

According to the present invention, a projection which can elastically project outward and elastically deformed inward can be provided on a portion of the outer periphery of the key frame. By configuring the key frame in this manner, the projection can be easily elastically deformed inward by pressing the projection from the outside. Therefore, the cover member for the push button switch having this key frame can be easily fitted to a product. Because the cover member can be fitted without deforming the elements other than the projection, it is possible to prevent deformation of the other members during fitting.

It is preferable that, in the key frame of the present invention, the projection projects beyond an outer periphery line of the key frame.

With this configuration, the projection can be elastically recovered while projecting outward when the cover member for the push button switch having the key frame is fitted to the product. Because of this, the cover can be assembled while the projection is in contact with the fitting portion provided on the side of the product. With this structure, the cover member for the push button switch having the key frame can be firmly fixed to the product, and occurrence of position shift or rattling of the cover member after assembly can be prevented.

It is preferable that, in the key frame of the present invention, a space is formed inside the projection.

With this configuration, the projection can be easily elastically deformed by pressing from the outside. Because of this, the projection can be easily moved inward, and, thus, the cover member for the push button switch can be more easily fitted.

A cover member for a push button switch according to the present invention is a cover member having a plurality of key tops, the cover member comprising the above-described key frame.

EFFECT OF THE INVENTION

With the key frame and the cover member for the push button switch according to the present invention, the key frame and the cover member can be easily fitted to a product and deformation during fitting can be prevented.

DESCRIPTION OF REFERENCE SYMBOLS

Figure 1:
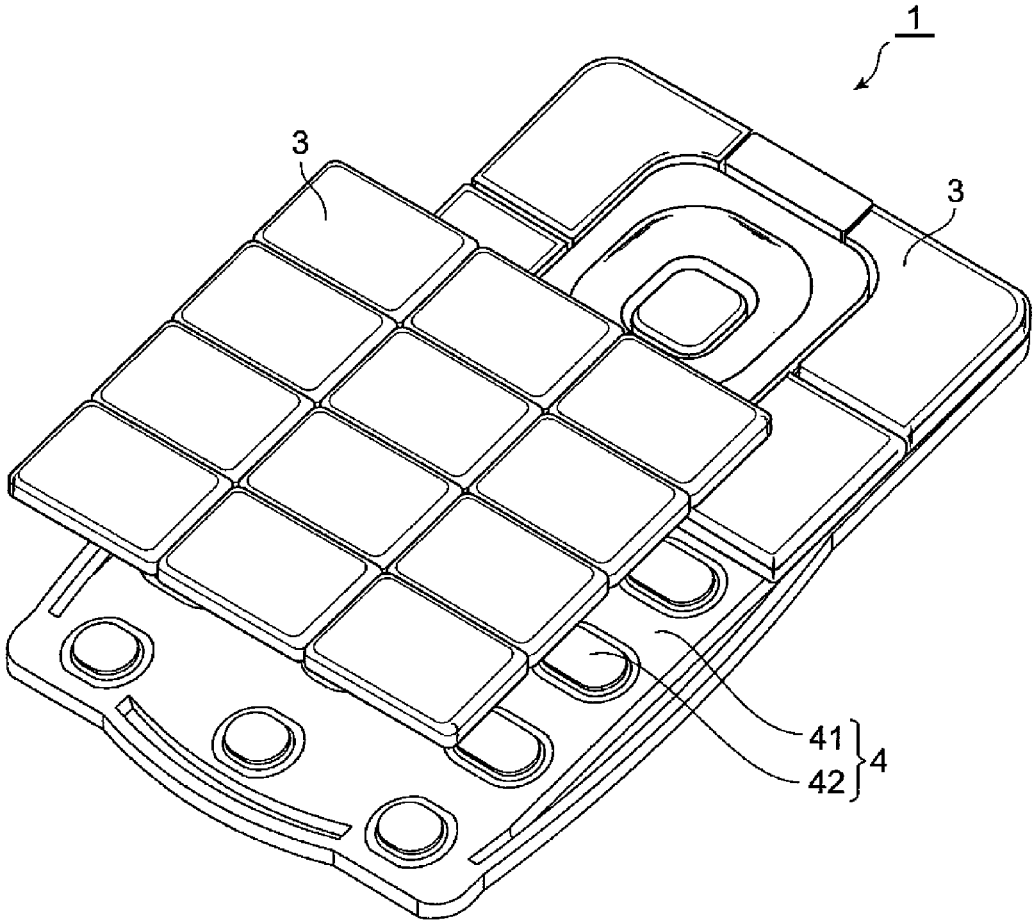
FIG. 1 is a perspective diagram of a cover member for a push button switch according to a preferred embodiment of the present invention.

1: cover member for push button switch, 3: key top, 4: key frame, 10: housing, 11: fitting portion, 41: hard base, 41*p*: elastic projection, 42: keypad.

BEST MODES FOR CARRYING OUT THE INVENTION

Embodiments of a key frame and a cover member for a push button switch according to the present invention will now be described with reference to the drawings. In the drawings, identical elements are assigned the same reference numerals and will not be repeatedly described.

Figure 2:
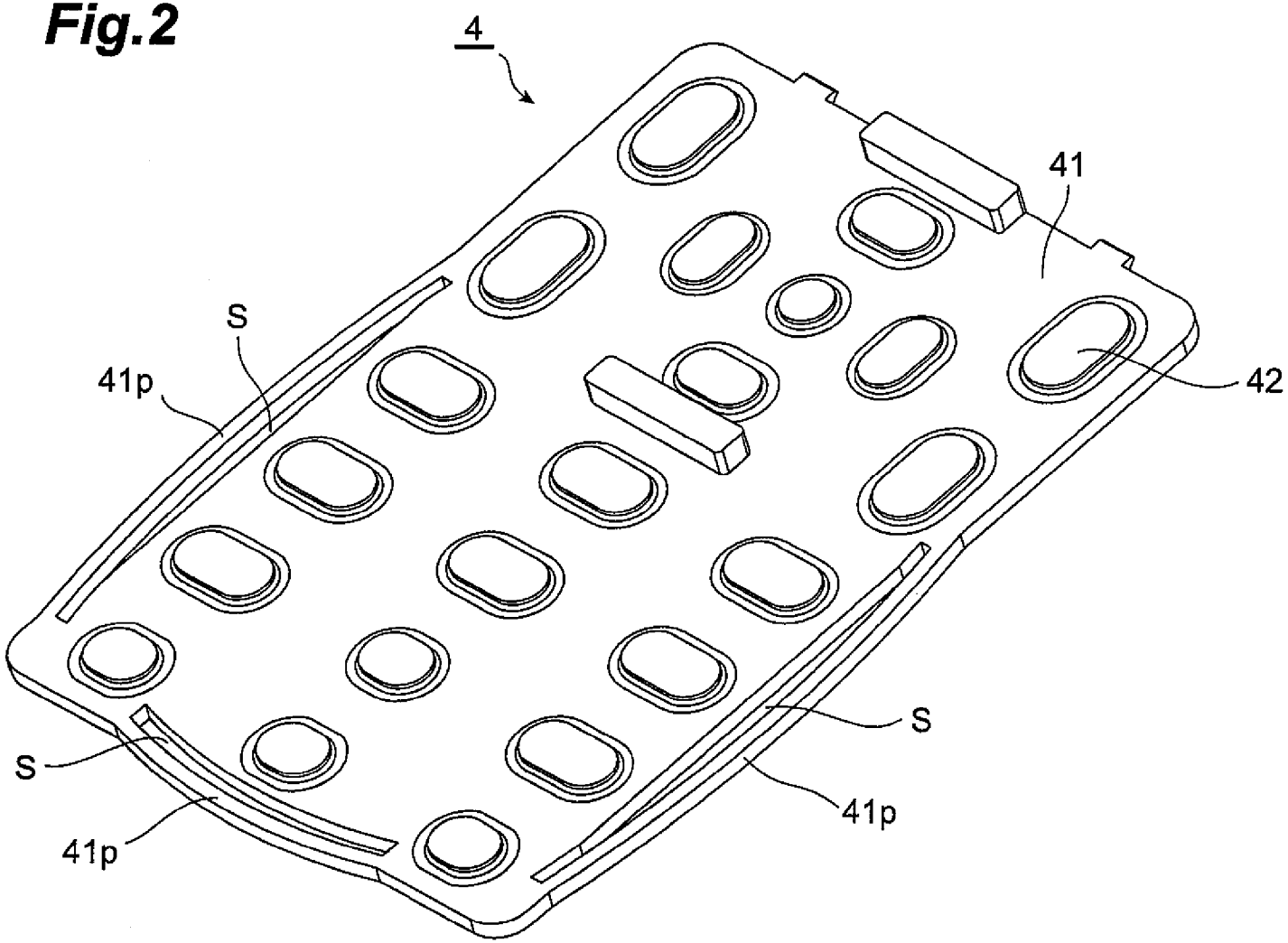
FIG. 2 is a perspective diagram of a key frame shown in FIG. 1.

First, a structure of a cover member for a push button switch and a key frame according to an embodiment of the present invention will be described with reference to FIGS. 1 and 2. As shown in FIG. 1, a cover member 1 for a push button switch comprises a plurality of rigid resin key tops 3 and a key frame 4 which supports a bottom of the cover member 1 for the push button switch. As shown in FIG. 2, the key frame 4 comprises a hard base 41 and a keypad 42.

The key top 3 of FIG. 1 is adhered to a front surface of the keypad 42 of the key frame 4. In order to not be sunk into a through hole formed in the hard base 41, the key top 3 is formed in a size which is slightly larger than an inner periphery of the through hole. The key top 3 elastically presses the keypad 42 of the key frame 4 with a stroke length of a projecting size. By employing a rigid resin for the key top 3, a firm texture can be provided as the texture of the key top which contacts a finger during operation, so that erroneous operation can be reduced.

An elastic projection 41*p* which elastically projects outward is provided on an outer periphery of a lower side and a lateral side of the hard base 41 shown in FIG. 2. The elastic projection 41*p* is formed projecting beyond the outer periphery line of the hard base 41, and functions as a fixing member when the cover member 1 for the push button switch is fitted to the housing of the portable phone. Here, the outer periphery line of the hard base 41 refers to a periphery line, among the periphery lines formed on the sides of the hard base 41, on which the elastic projection 41*p* is formed and which is formed by the hard base body other than the elastic projection 41*p* (same definition applies in the following description).

A space S is formed on an inner side (side near the through hole) of the elastic projection 41*p*. By providing the space S, it is possible that the elastic projection 41*p* which is inwardly and elastically deformed proceeds into the space S when the elastic projection 41*p* is pressed from the outside. With this structure, the elastic projection 41*p* projecting from the outer periphery line of the hard base 41 can be elastically deformed so that the elastic projection 41*p* retracts inwardly in the hard base 41.

Figure 3:
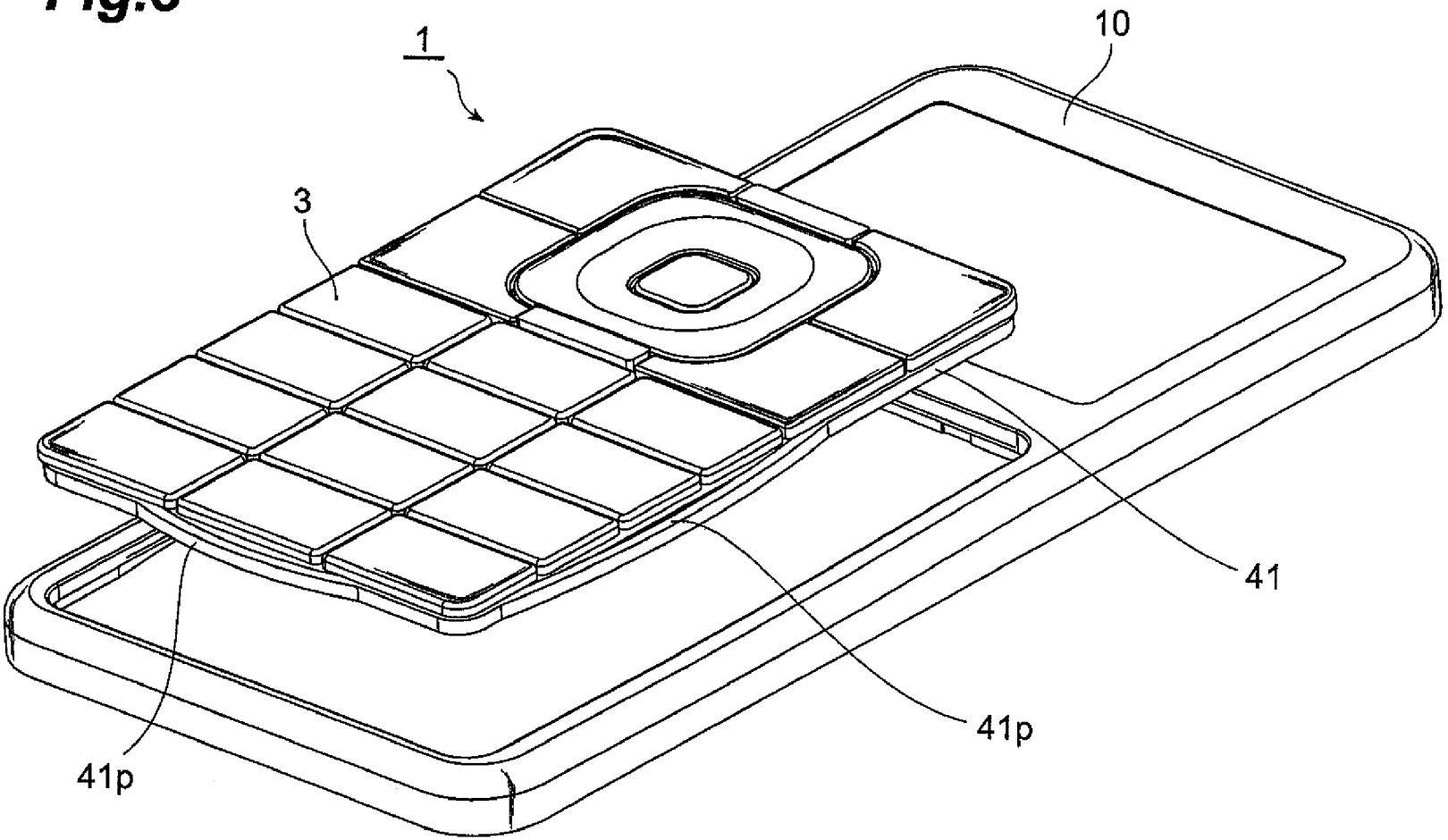
FIG. 3 is a perspective diagram showing a cover member for a push button switch shown in FIG. 1 and a housing of a portable phone on a front side to which the cover member for the push button switch is fitted.
Figure 4:
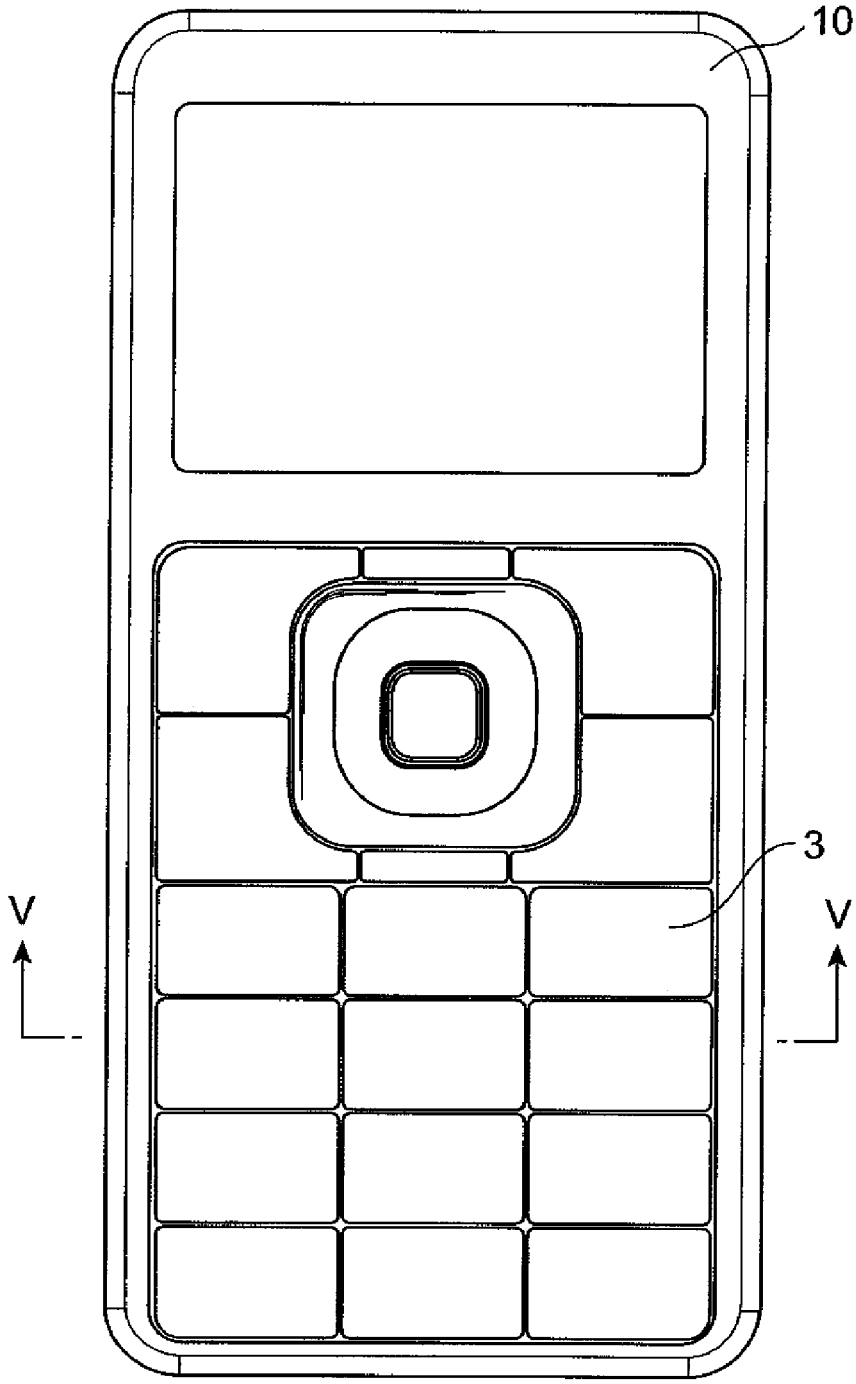
FIG. 4 is a diagram showing a state of the cover member for the push button switch of FIG. 1 fitted to the housing seen from the top.
Figure 5:
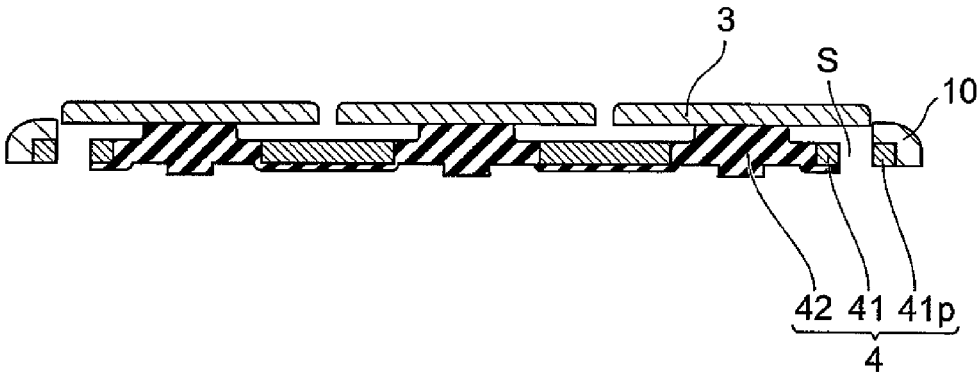
FIG. 5 is a V-V arrow diagram of FIG. 4.
Figure 6:
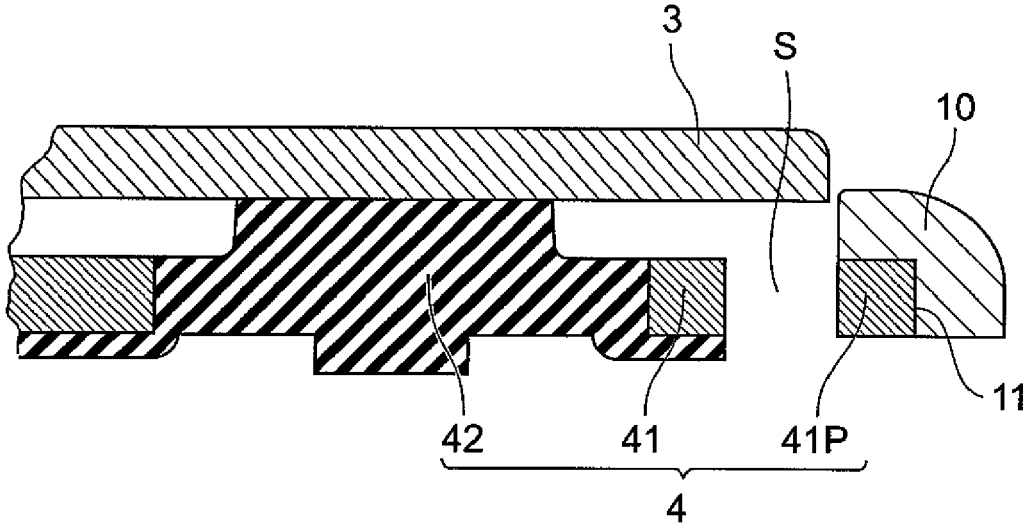
FIG. 6 is an enlarged view Of a part of the cross sectional view of FIG. 5.

The elastic projection 41*p* will now be described in more detail with reference to FIGS. 3 to 6. FIG. 3 is a diagram showing the cover member 1 for the push button switch and a housing 10 on a front side of a portable phone to which the cover member 1 for the push button switch is fitted. FIG. 4 is a diagram showing a state of the cover member 1 for the push button switch fitted to the housing 10, seen from the top. FIG. 5 is a V-V arrow diagram of FIG. 4. FIG. 6 is a diagram enlarging a portion of the cross sectional view shown in FIG. 5.

As shown in FIG. 3, the elastic projection 41*p* is formed projecting outward from the outer periphery line of the hard base 41. Because the space S is formed inside the elastic projection 41*p*, when the elastic projection 41*p* is pressed from the outside, the elastic projection 41*p* is elastically deformed and easily moved inwardly in the hard base 41. With this structure, the cover member 1 for the push button switch can be easily fitted to the housing 10, and a work efficiency can be improved. In addition, because the elastic projection 41*p* can be easily deformed, the cover member 1 can be fitted to the housing 10 without deforming the body of the key frame 4. Thus, deformations of the key frame 4 and the cover member 1 can be prevented.

As shown in FIGS. 5 and 6, the elastic projection 41*p* is assembled to the housing 10 while the elastic projection 41*p* contacts a fitting portion 11 provided on the side of the housing 10. In other words, the elastic projection 41*p* fitted to the fitting portion 11 is fixed in the shape of the fitting portion 11 while the elastic projection 41*p* is elastically recovering outward. With this structure, the cover member 1 for the push button switch can be firmly fixed in the housing 10, and the position shift and the rattling of the cover member 1 after assembly can be prevented. In addition, falling off of the cover member 1 in the product dropping test executed after the assembly can be prevented.

The keypad 42 of FIG. 2 is formed of a semitransparent silicone rubber film having a thin thickness. The keypad 42 is formed on a backside of the hard base 41, and thinly covers the entire backside of the hard base 41. The keypad 42 formed on the backside of the hard base 41 reaches the front side of the hard base 41 through an inner periphery of the through hole of the hard base 41. The keypad 42 forms a pressing projection for pressing a contact portion near an inner region of the through hole of the hard base 41. On a front surface of the keypad 42 which corresponds to an upper side of the pressing projection, a base of the key top 3 is formed. The base is bulged with a thick thickness in an area slightly internal than the inner periphery of the through hole, and projects slightly more than the surface of the hard base 41.

Figure 7:
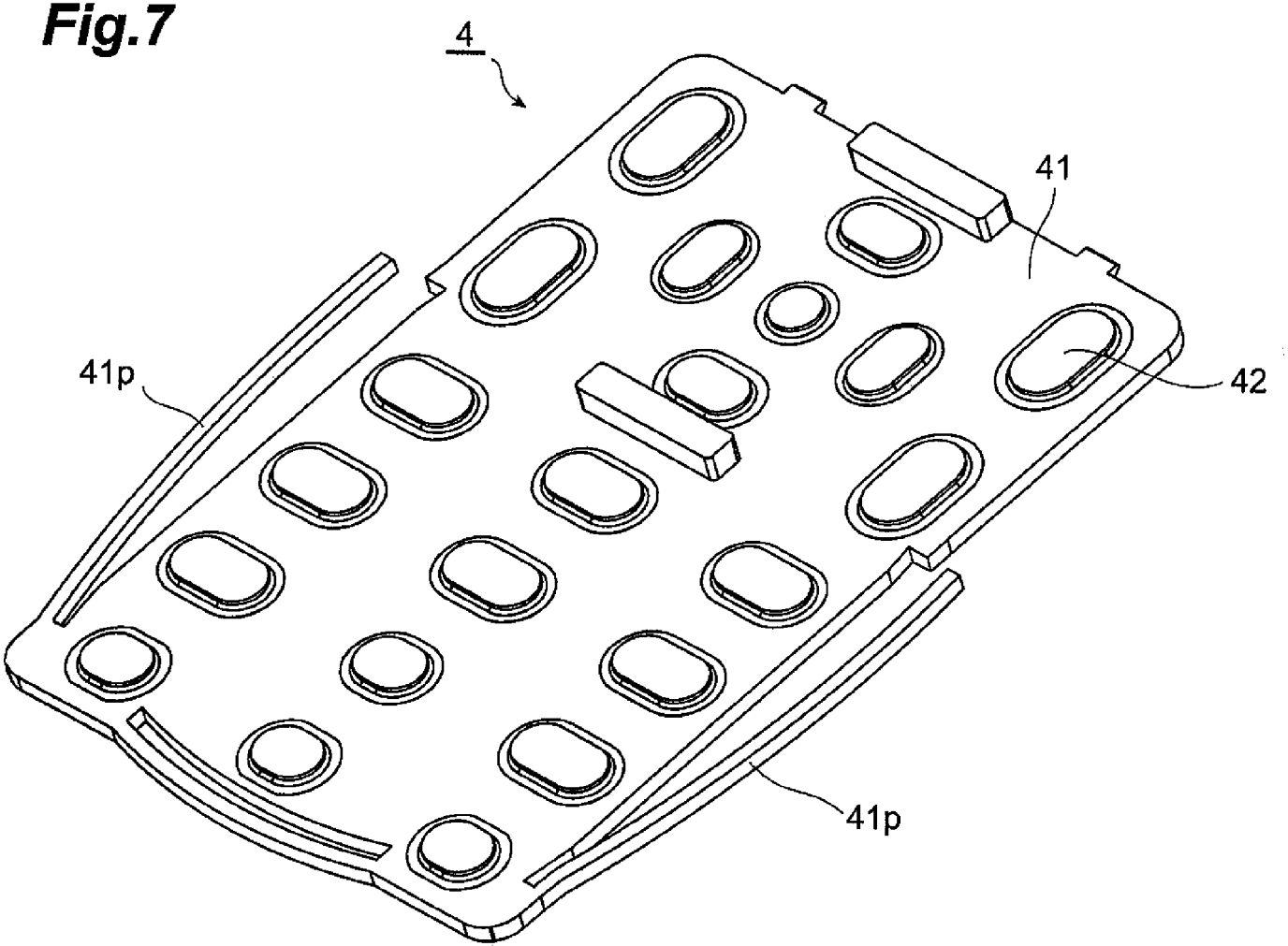
FIG. 7 is a perspective diagram of a key frame in a modified embodiment of the present invention.

The elastic projection 41*p* in the above-described embodiment is not limited to the shape shown in FIG. 2. For example, the elastic projection 41*p* may have a shape of a cantilever as shown in FIG. 7. In other words, the elastic projection 41*p* only needs to be formed in a shape which can elastically project outward.

In the above-described embodiment, the space S is formed inside the elastic projection 41*p*, but the space S does not necessarily be formed. For example, the elastic portion may be provided by filling a portion corresponding to the space S with an elastic material. Alternatively, it is also possible to form the elastic projection itself with an elastic material without forming the space S. In other words, it is only necessary that the elastic projection 41*p* can be elastically deformed such that a portion projecting outward is moved toward the inside and retracted when the elastic projection 41*p* is pressed from the outside. Here, as the elastic material, for example, a material which can be compressed may be used such as a rubber and a thermoplastic elastomer. More specifically, for example, a thermosetting elastomer such as a silicone rubber, an isoprene rubber, an ethylene propylene rubber, a butadiene rubber, a chloroprene rubber, a natural rubber, etc., or a thermoplastic elastomer such as a styrene-based elastomer, an ester-based elastomer, an urethane-based elastomer, an olefin-based elastomer, an amide-based elastomer, a butadiene-based elastomer, an ethylene-vinyl acetate-based elastomer, a fluorine-contained rubber-based elastomer, an isoprene-based elastomer, a chlorinated polyethylene-based elastomer, etc. may be used. Among these elastic materials, the silicone rubber, the styrene-based thermoplastic elastomer, and the ester-based thermoplastic elastomer are preferable because the impact resilience is high and the permanent compression strain is small.

In the above-described embodiment, the elastic projection 41*p* is provided on the lower side and the lateral side of the hard base 41, but the location and number of provision of the elastic projection 41*p* are not limited to this configuration. It suffices that an elastic projection is provided on at least one side of the hard base. When the hard base 41 has four sides as in the present embodiment, by providing the elastic projection on each of the outer peripheries of three sides, it is possible to enable easier fitting of the cover member 1 for the push button switch and firm fixing of the cover member 1 for the push button switch.

Figure 8:
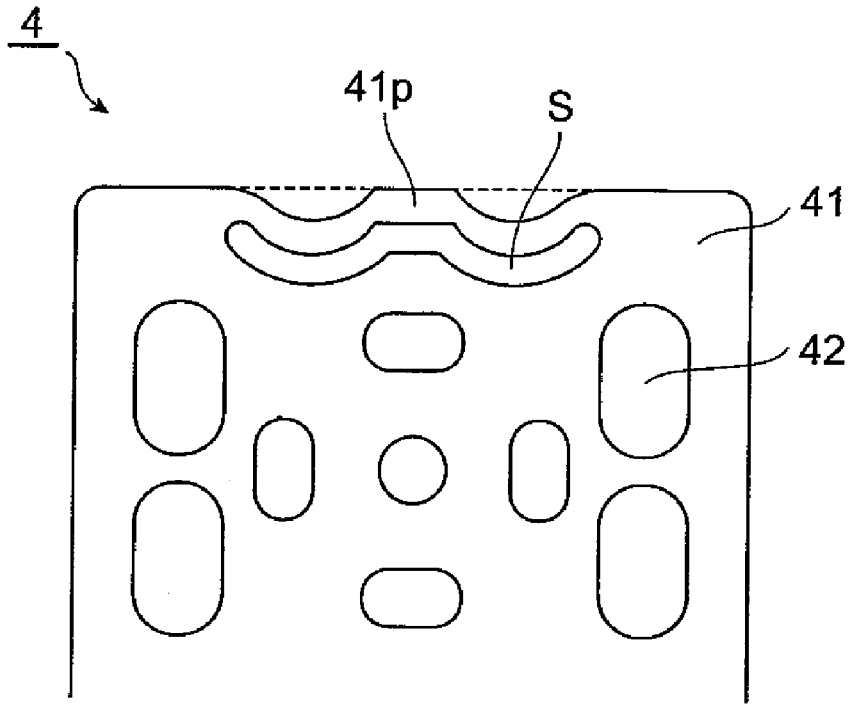
FIG. 8 is a diagram showing an elastic projection of a key frame in a modified embodiment of the present invention.
Figure 9:
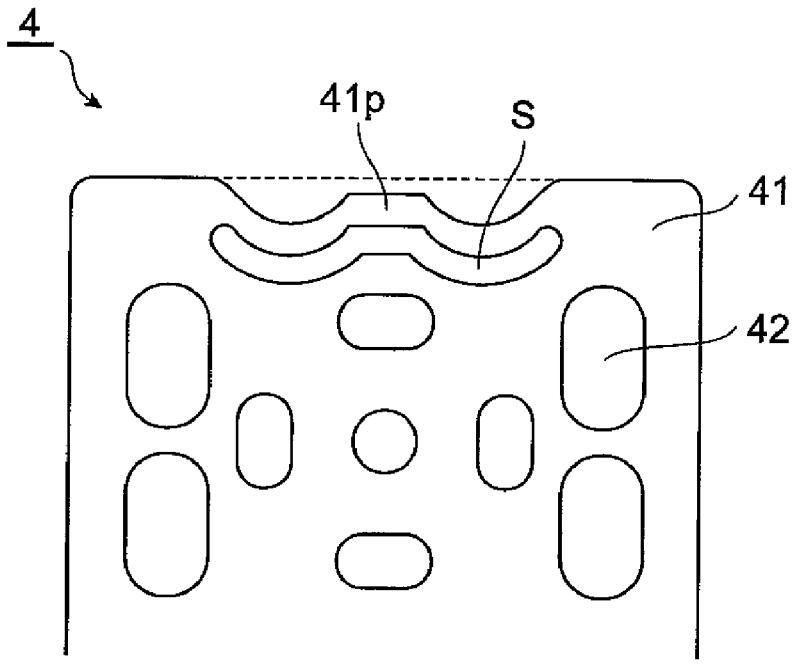
FIG. 9 is a diagram showing an elastic projection of a key frame in a modified embodiment of the present invention.
Figure 10:
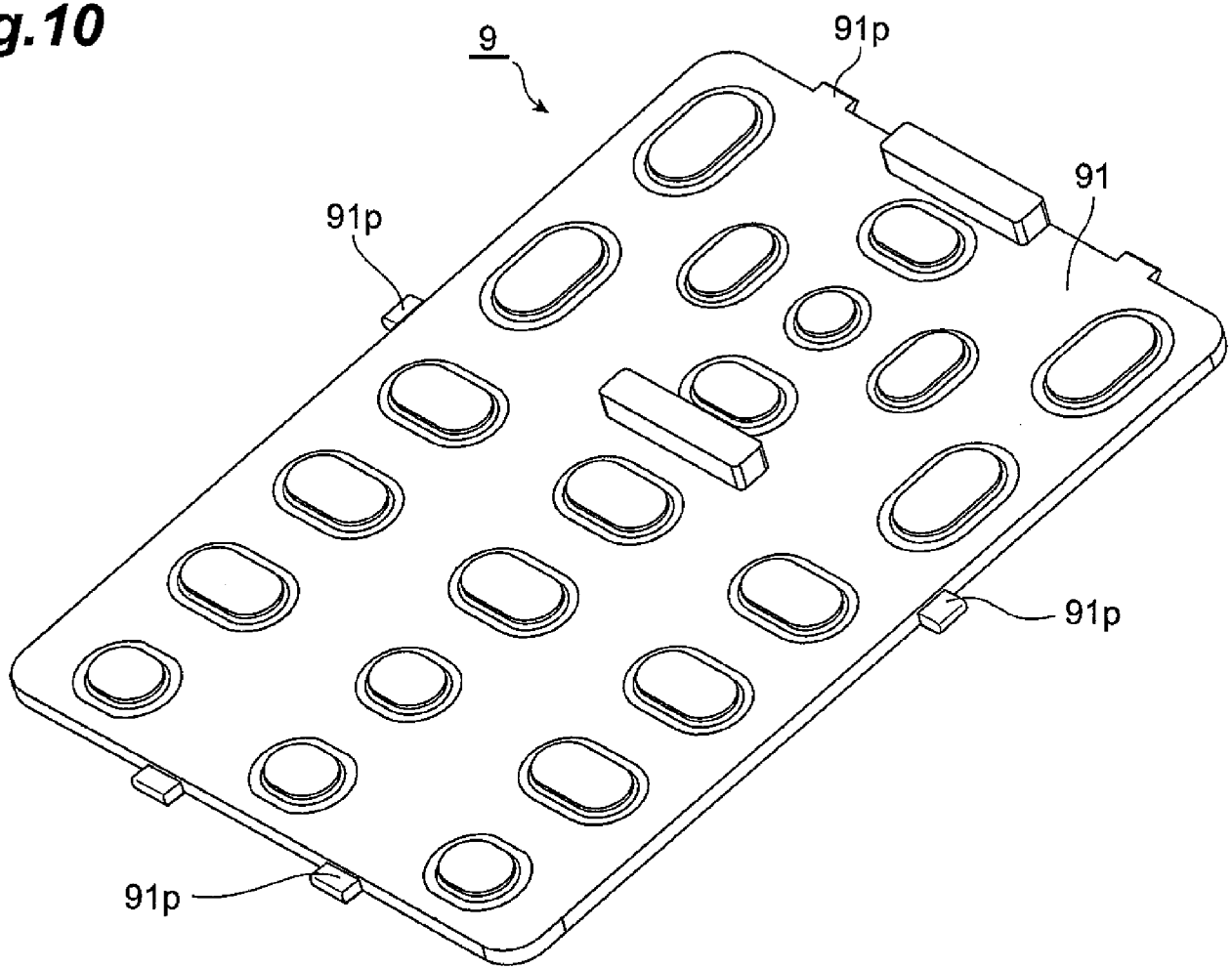
FIG. 10 is a perspective diagram of a conventional key frame.

The elastic projection 41*p* in the above-described embodiment is formed projecting beyond the outer periphery line of the hard base 41, but the elastic projection 41*p* is not limited to a structure projecting beyond the outer periphery line. For example, the elastic projection 41*p* may be formed on the outer periphery line of the hard base 41 as shown in FIG. 8 or the elastic projection 41*p* may be formed at a position inner than the outer periphery line of the hard base 41 as shown in FIG. 9.

Figure 11:
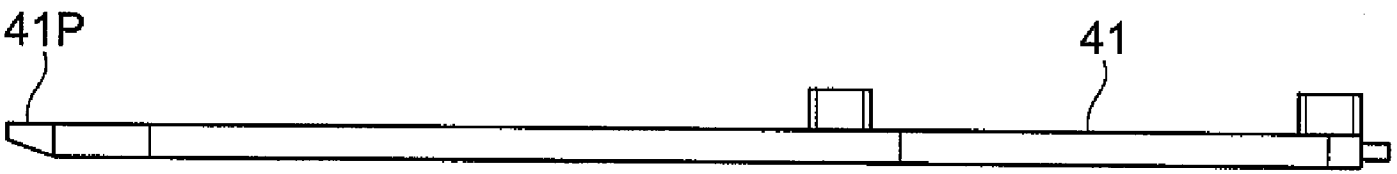
FIG. 11 is a right side view of a key frame in the modified embodiment of the present invention.

Alternatively, it is also possible to provide a slope to the lower surface side of the elastic projection 41*p* provided on the lower side and the lateral side of the hard base 41 so that the thickness is reduced toward the outer periphery of the key frame 4 as shown in FIG. 11. FIG. 11 is a right-side view of the key frame 4 in this modified embodiment. The lower surface side of the elastic projection 41*p* is the portion which contacts the housing 10 when the key frame 4 is fitted to the housing 10. Therefore, by providing a slope to the lower surface side of the elastic projection 41*p*, it is possible to fit the key frame 4 to the housing 10 by pressing the hard base 41 near the elastic projection 41*p* from the top (pressing from the front side toward the backside of the hard base 41). With this structure, the work efficiency can be significantly improved compared to a configuration in which the elastic projection 41*p* is fitted while being pressed from the outside. A process to fit the key frame 4 to the housing 10 in the modified embodiment will now be described. First, a hook provided on an upper side of the hard base 41 is inserted into an insertion portion provided on the side of the housing 10. Then, the hard base 41 near the elastic projection 41*p* provided on the lower side and the lateral side of the hard base 41 is pressed from the front side toward the backside of the hard base 41. With this process, the elastic projection 41*p* is inserted into the fitting portion provided on the side of the housing 10, and the key frame is fitted to the housing 10.

The invention claimed is:

1. A key frame which supports a bottom of a cover member for a push button switch, the key frame comprising:

a base comprising a plurality of holes, a plurality of key pads, each of which are installed through one of the holes, a projection which is formed on at least a portion of an outer periphery and which can elastically project outward, wherein the projection can be elastically deformed inward, wherein the cover member comprises a plurality of key tops, wherein each of the key pads supports bottom surfaces of one of the key tops, and wherein the key frame and the key tops are separably assembled with one another.

2. The key frame according to claim 1, wherein the projection projects beyond an outer periphery line.

3. The key frame According to claim 2, wherein a space is formed inside the projection.

4. The key frame according to claim 1, wherein a space is formed inside the projection.

5. The key frame according to claim 4, wherein the projection is inwardly and elastically deformable and functions as a fixing member for being fitted into a housing when being pressed from the outside.

6. The key frame according to claim 1, wherein the projection is inwardly and elastically deformable and functions as a fixing member for being fitted into a housing when being pressed from the outside.

7. The key frame according to claim 1, wherein the projection has a shape of a cantilever and one end of the projection is fixed to the outer periphery.

8. The key frame according to claim 1, wherein a tip of the projection is in alignment with a part of the outer periphery.

9. The key frame according to claim 1, wherein a tip of the projection is positioned inward with respect to a part of the outer periphery.

10. The key frame according to claim 1, wherein the projection is sloped so that a thickness of the projection is reduced toward the outer periphery.

11. A cover member for a push button switch having a plurality of key tops, the cover member comprising:

a key frame which supports a bottom of a cover member for a push button switch and includes a projection which is formed on at least a portion of an outer periphery and which can elastically project outward, wherein the projection can be elastically deformed inward, wherein the key frame comprises a base comprising a plurality of holes, wherein the key frame comprises a plurality of key pads, each of which are installed through one of the holes, wherein each of the key pads supports bottom surfaces of one of the key tops, and wherein the key frame and the key tops are separably assembled with one another.

12. The cover member according to claim 11, wherein the projection projects beyond an outer periphery line.

13. The cover member according to claim 11, wherein a space is formed inside the projection.

14. The cover member according to claim 13, wherein the projection is inwardly and elastically deformable and functions as a fixing member for being fitted into a housing when being pressed from the outside.

15. The cover member according to claim 12, wherein a space is formed inside the projection.

16. The cover member according to claim 11, wherein the projection is inwardly and elastically deformable and functions as a fixing member for being fitted into a housing when being pressed from the outside.

17. The cover member according to claim 11, wherein the projection has a shape of a cantilever and one end of the projection is fixed to the outer periphery.

18. The cover member according to claim 11,
wherein a tip of the projection is in alignment with a part of the outer periphery.

19. The cover member according to claim 11,
wherein a tip of the projection is positioned inward with respect to a part of the outer periphery.

20. The cover member according to claim 11,
wherein the projection is sloped so that a thickness of the projection is reduced toward the outer periphery.

* * * * *